US011280146B2

(12) United States Patent
Swinford

(10) Patent No.: US 11,280,146 B2
(45) **Date of Patent: *Mar. 22, 2022**

(54) FLUID DRIVEN JARRING DEVICE

(71) Applicant: Jason Swinford, Spring, TX (US)

(72) Inventor: Jason Swinford, Spring, TX (US)

( * ) Notice: Subject to any disclaimer, the term of this patent is extended or adjusted under 35 U.S.C. 154(b) by 71 days.

This patent is subject to a terminal disclaimer.

(21) Appl. No.: 17/005,000

(22) Filed: Aug. 27, 2020

(65) Prior Publication Data

US 2020/0399970 A1 Dec. 24, 2020

Related U.S. Application Data

(63) Continuation-in-part of application No. 16/443,915, filed on Jun. 18, 2019, now Pat. No. 10,760,365.

(51) Int. Cl.
*E21B 31/113* (2006.01)

(52) U.S. Cl.
CPC ..... *E21B 31/1135* (2013.01)

(58) Field of Classification Search
USPC ..... 173/201; 175/293, 298
See application file for complete search history.

(56) References Cited

U.S. PATENT DOCUMENTS 1,996,370 A * 4/1935 Erwin ..... E21B 31/113 175/232
2009/0301744 A1* 12/2009 Swinford ..... E21B 4/14 173/200
2011/0127044 A1* 6/2011 Radford ..... E21B 10/322 166/373
2011/0203800 A1* 8/2011 Tinker ..... E21B 34/14 166/318
2014/0318816 A1* 10/2014 Hofman ..... E21B 34/14 166/386
2015/0211317 A1* 7/2015 Swinford ..... E21B 31/113 166/178
2016/0040508 A1* 2/2016 Webster ..... E21B 21/103 166/244.1
2017/0247969 A1* 8/2017 Jones ..... E21B 23/04
2019/0271204 A1* 9/2019 Watson ..... E21B 31/1135

* cited by examiner

*Primary Examiner* — Chinyere J Rushing-Tucker

(74) *Attorney, Agent, or Firm* — Eric P. Mirabel, JD, LLM

(57) ABSTRACT

The disclosed jarring device generates two jarring impacts at the end points of a reciprocating hammer assembly. Initially, flow of pressurized fluid through the jarring device is obstructed by a deformable member. The resulting increase in fluid pressure upstream of the deformable member causes compression of a spring and downstream movement of the hammer assembly to generate a first jarring impact. A further increase in fluid pressure beyond a threshold, causes a release of the obstruction by either deforming the member or by slicing it by pushing it through a slicer. Releasing of the obstruction causes decompression of the spring, and upstream sliding of the hammer assembly to generate a second jarring impact.

21 Claims, 15 Drawing Sheets

FLUID DRIVEN JARRING DEVICE

RELATED APPLICATIONS

This application is a continuation-in-part of US application Ser. No. 16/443,915, filed Jun. 18, 2019.

BACKGROUND

Tools used in oil and gas drilling, particularly jarring devices ("jars" see e.g. U.S. Pat. Nos. 9,038,744; 8,151,910, respectively entitled: "Jet Hammer" and "Drilling Jar," both incorporated by reference) are usually part of the bottom hole assembly (BHA). The BHA is at the lower-end of a drill string (which is also referred to herein as a "string" or "work string," and includes both coil tubing and pipe strings). The BHA consists of (from the bottom up in a vertical well) the drill bit, the drill bit sub, optionally, a mud motor (used for driving of the bit hydraulically without rotating the work string) as well as stabilizers, which keep the assembly centered in the hole, a drill collar (heavy, thick-walled tubes used to apply weight to the drill bit) and preferably jars and, as needed, crossovers (adaptors) for fitting together different thread forms on the various components.

Directional drilling is now commonplace, and allows turning a vertical drill string and boring horizontally, or at any angle between horizontal and vertical. Some wells now extend over 10 km from the surface start location, but at a true vertical depth of only 1,600-2,600 m. With directional drilling, and with very deep wells, it's often preferable to place jars at intervals along the string, as well as at the BHA. During drilling of such wells, the drill string often sticks, and needs to be jarred loose.

Following or in conjunction with the initial drilling, hollow metallic tubes (known as "casings") may be inserted within the bore to prevent walls of the bore from collapsing. Usually, multiple hollow casings are installed vertically one above the other by screwing ends of adjacent casings with each other. The entire assembly of attached casings is commonly known as a "bore casing." Once a bore casing is formed, a variety of equipment (including crude oil pumping equipment, preferably coil tubing, as well as sensor equipment) can be installed within the bore casing. In an operational oil well, crude oil is pumped to the surface of the earth from the buried crude oil deposits with the help of pumping equipment installed in the bore casing.

Even inside a casing, however, the coil tubing may bind against the casing inner walls, especially in a deep well. Also, the performance and efficiency of the production is vulnerable to failure of equipment installed within bore casing, or changed conditions within the well bore. Trouble-shooting of such problems often requires liberating stuck equipment with a jar, which may be followed by retrieval (or fishing) of equipment within the bore casing.

Coiled tubing rides out on a powered drum and is movable vertically within the bore casing. The jarring device is capable of providing a striking impact (or a shock wave) in both upwards and downwards directions, in order to free trapped equipment or bound tubing.

Often, installed equipment within a well bore casing is held together by interlocking friction fittings. For successful separation of such installed equipment assembly, it is important that the jarring impact is strong enough to overcome shock absorption which may occur due to movement at the friction fittings.

In the jarring device disclosed in U.S. Pat. No. 8,151,910 (the '910 Patent), one exerts, from the surface, either stretch or compression forces on a mandrel, and uses mechanical friction in order to load the potential energy of the stretch or compression forces. Overcoming the friction leads to a sudden release of the mandrel, which generates a significant striking impact against an anvil; which in turn generates a shock wave along the coil tubing, which travels to the stuck equipment or stuck tubing portion.

Another jarring device, disclosed in U.S. Pat. No. 10,267,114 (the '114 Patent; incorporated by reference) uses the principle of sudden release of pressurized fluid to generate mechanical movement and a striking impact. The fluid flow is initially blocked by a deformable sphere, and released when the sphere deforms and travels through the blocked channel in the device. Though this is principle of operation is advantageous in not requiring stretching or compression of the drill string (which may be somewhat more likely to affect the string or other equipment, such as the BHA) the '114 Patent device does not provide storage of a substantial amount of potential energy before release, and would be expected not to generate a significant, or adequate, jarring impact to release highly bound tubing or stuck equipment.

While using the principle of a deformable or dispensable sphere to block fluid flow is a simple, feasible method of jar operation, there is a need for an improved jarring device which provides a stronger jarring impact than the'114 Patent device.

SUMMARY

The jarring device of the invention generates strong jarring impacts by first compressing a spring to slide a hammer assembly under the pressure generated by obstructing the flow path of pressurized fluid using a deformable sphere, and then causing rapid spring decompression, resulting in a rapid reverse slide of the hammer assembly, by opening the obstructed flow path by deforming or slicing the deformable sphere.

In one embodiment of the jarring device, a deformable sphere is pumped down into the jarring device together with pressurized fluid. The deformable sphere obstructs a narrow fluid flow path, and causes a sudden rise in fluid pressure upstream, which causes compression of a spring and movement of a hammer assembly downstream to generate a first jarring impact. The fluid pressure is increased until the sphere deforms sufficiently to enter and travel through the narrowed fluid flow path and get ejected out the lower end thereof. Upon ejection, there is a rapid drop in fluid pressure which leads to decompression of the spring, whereby the hammer assembly slides upstream to generate a second, far stronger jarring impact.

In another embodiment, a series of deformable spheres, preferably, connected together on a stem, are pumped down into the jarring device, with each sphere in the series acting to cause jarring impacts as described above.

This and other details of the embodiments of the invention are explained in the detailed description below.

Figure 1:
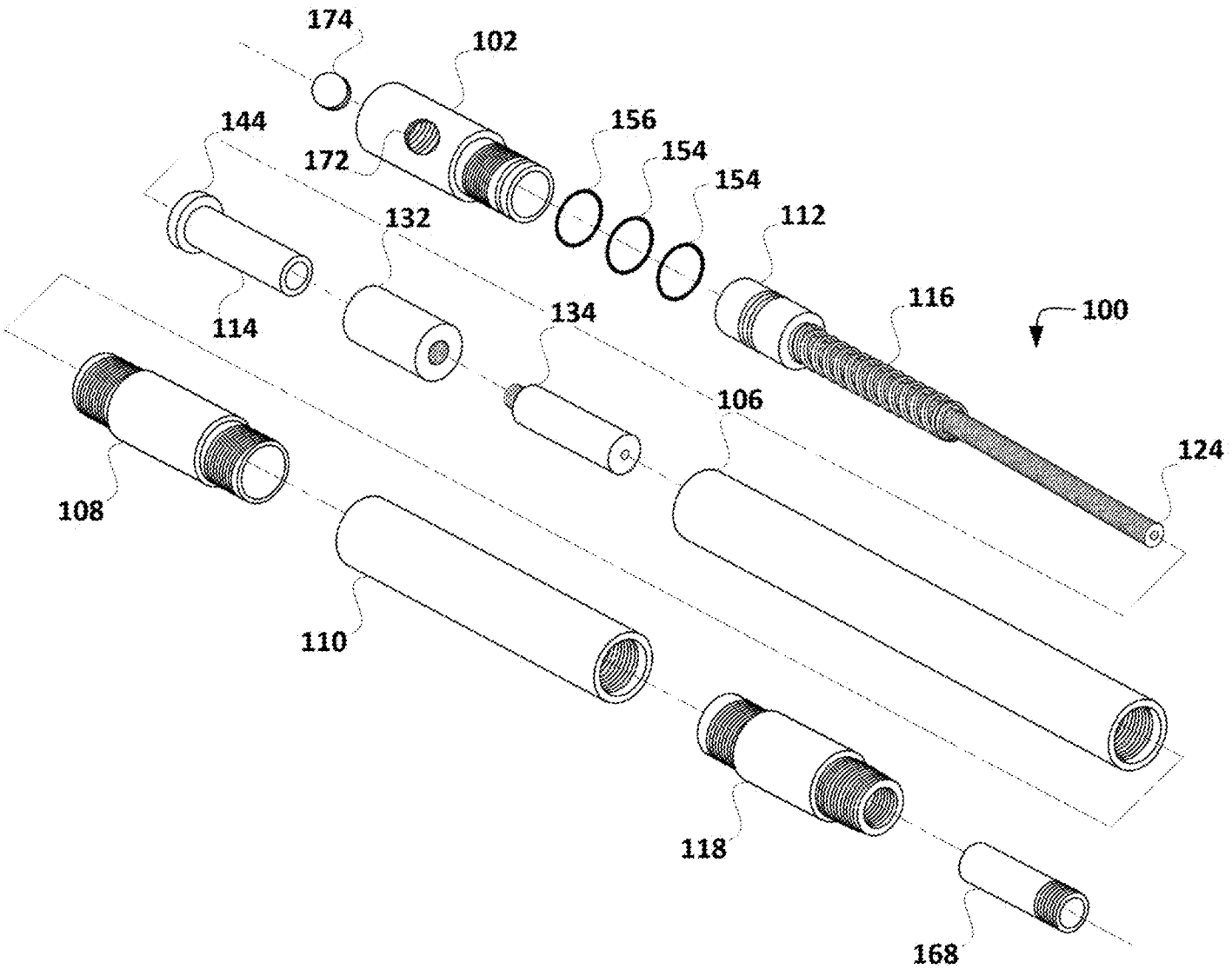
FIG. 1 illustrates an exploded view of a first embodiment of a jarring device in accordance with the present invention.

It is to be noted that in the accompanying figures, the sphere (in its normal, deformed or sliced form) and the spring are shown in perspective and not in sectional view.

The drawings and the associated description below are intended and provided to illustrate one or more embodiments of the present invention, and not to limit the scope of the invention. Also, it should be noted that the drawings are not necessarily drawn to scale.

DETAILED DESCRIPTION

A first embodiment of a jarring device 100 and its operation is shown in FIGS. 1, 2, 3A to 3D and 4. In jarring device 100, pressurized fluid pumped from the surface enters through fluid inlet end 104 of the upper sub 102 and exits through end 120 of the lower sub 118. Throughout the description provided herein the term "downstream" refers to the direction from the upper sub 102 towards the lower sub 118, and the term "upstream" is the opposite direction.

The upper sub 102 is concentric with a funneled fluid inlet 138 of a pressurizing insert 112 and is screwed to inner surface of upper barrel 106. The upper sub 102 includes central bore 126 aligning with the widest end of fluid inlet 138. The pressurizing insert 112 further includes a seat 122 for spring 116 at its lower end, and an externally threaded shaft 124 extending through the center of spring 116.

A channel 166 which extends through shaft 124 (and partially through seat 122) is aligned with the lower end of fluid inlet 138 and, at its lower end it aligns with the central bore of a lower hammer head 134. The lower end of the externally threaded shaft 124 and an externally threaded extension 148 of the lower hammer head 134 are both screwed into an internally threaded bore of an upper hammer head 132. The assembly of upper hammer head 132, the lower hammer head 134, the pressurizing insert 112 and the spring 116 move together and are herein referred to as the hammer assembly of the jarring device 100.

The upper sub 102 further includes an emergency pressure release vent 172 interconnecting the central bore 126 to the exterior of jarring device 100. A rupture disc 174 is screwed into the internally threaded exit of the pressure release vent 172. The rupture disc 174 creates a leakproof plugging of the emergency pressure release vent 172, prior to over-pressure causing rupture and pressure release.

The lower external surface of the upper barrel 106 is threaded to the upper inner surface of a center sub 108, and the upper external surface of lower barrel 110 is threaded to the lower inner surface of the center sub 108. The lower inner surface of lower barrel 110 is threaded to the outer upper surface of lower sub 118. The outer lower end of lower sub 118 attaches to the drill string (not illustrated), as does the inner upper end of upper sub 102 (not illustrated).

Figure 3A:
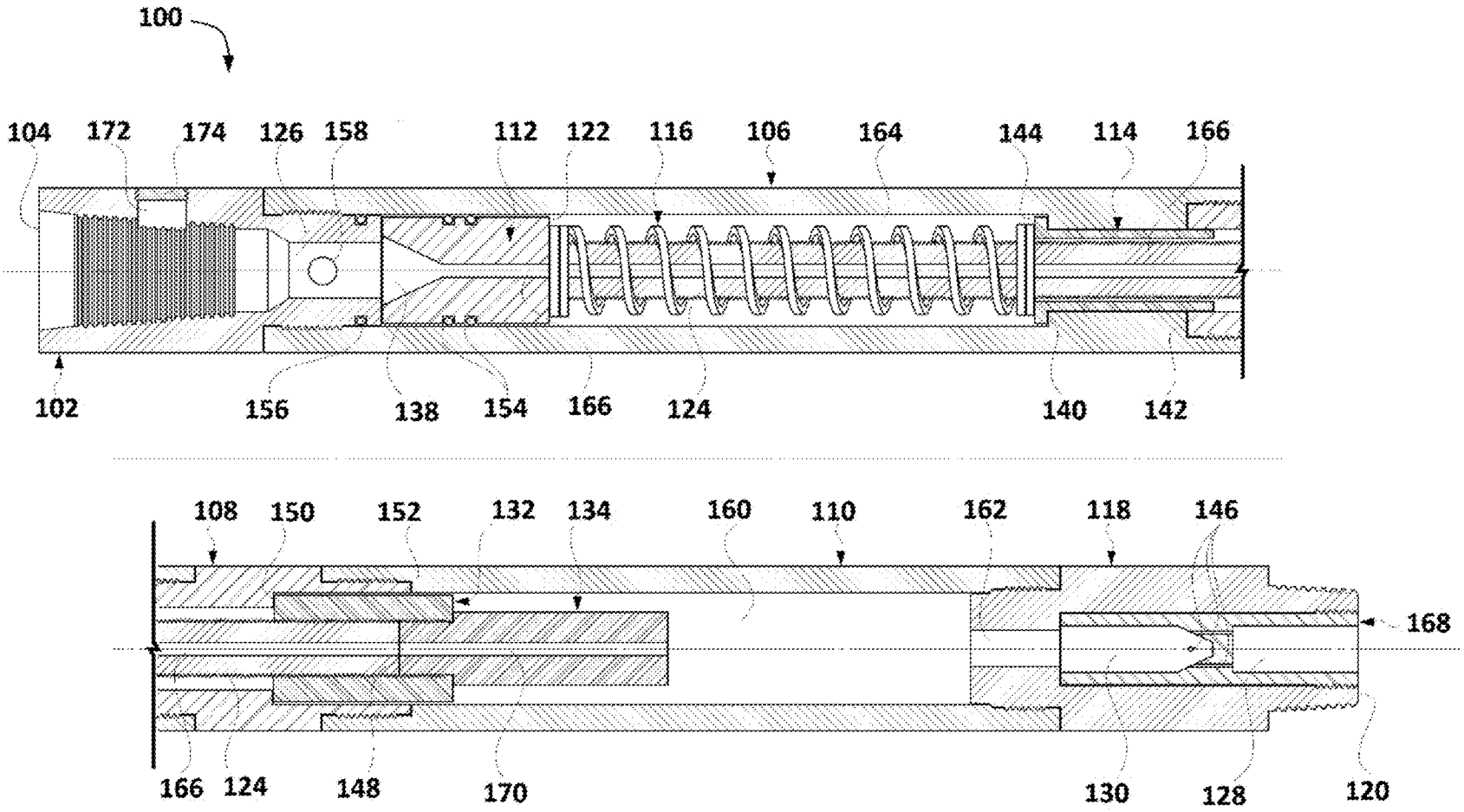
FIG. 3A shows the same view as FIG. 2, but with deformable sphere 158 traveling further downstream and towards the inlet 138 to block the fluid flow.
Figure 3B:
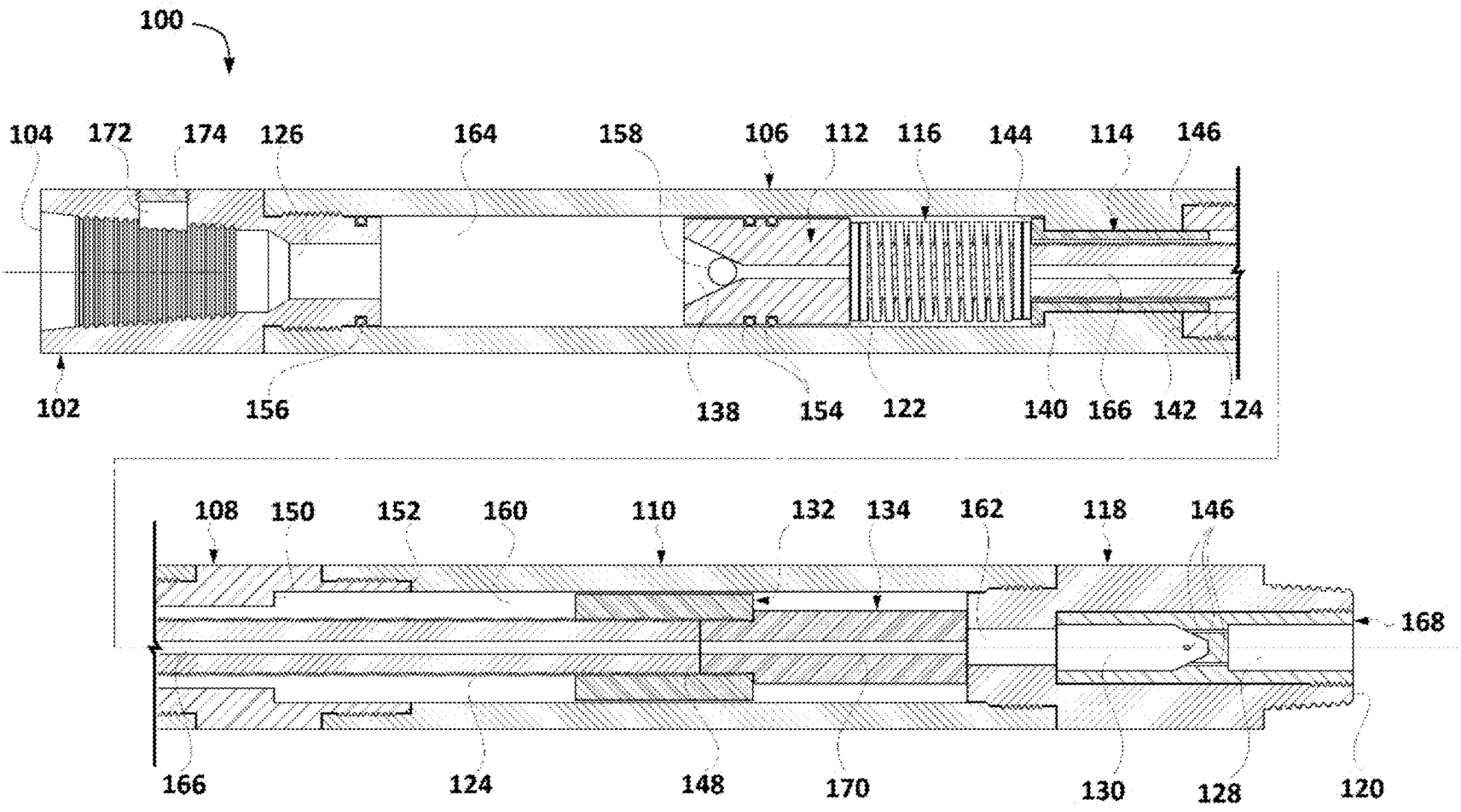
FIG. 3B shows the position of the device shown in FIGS. 2 & 3A, following blocking of the inlet 138 by deformable sphere 158, thereby initiating partial compression of spring 116.
Figure 3C:
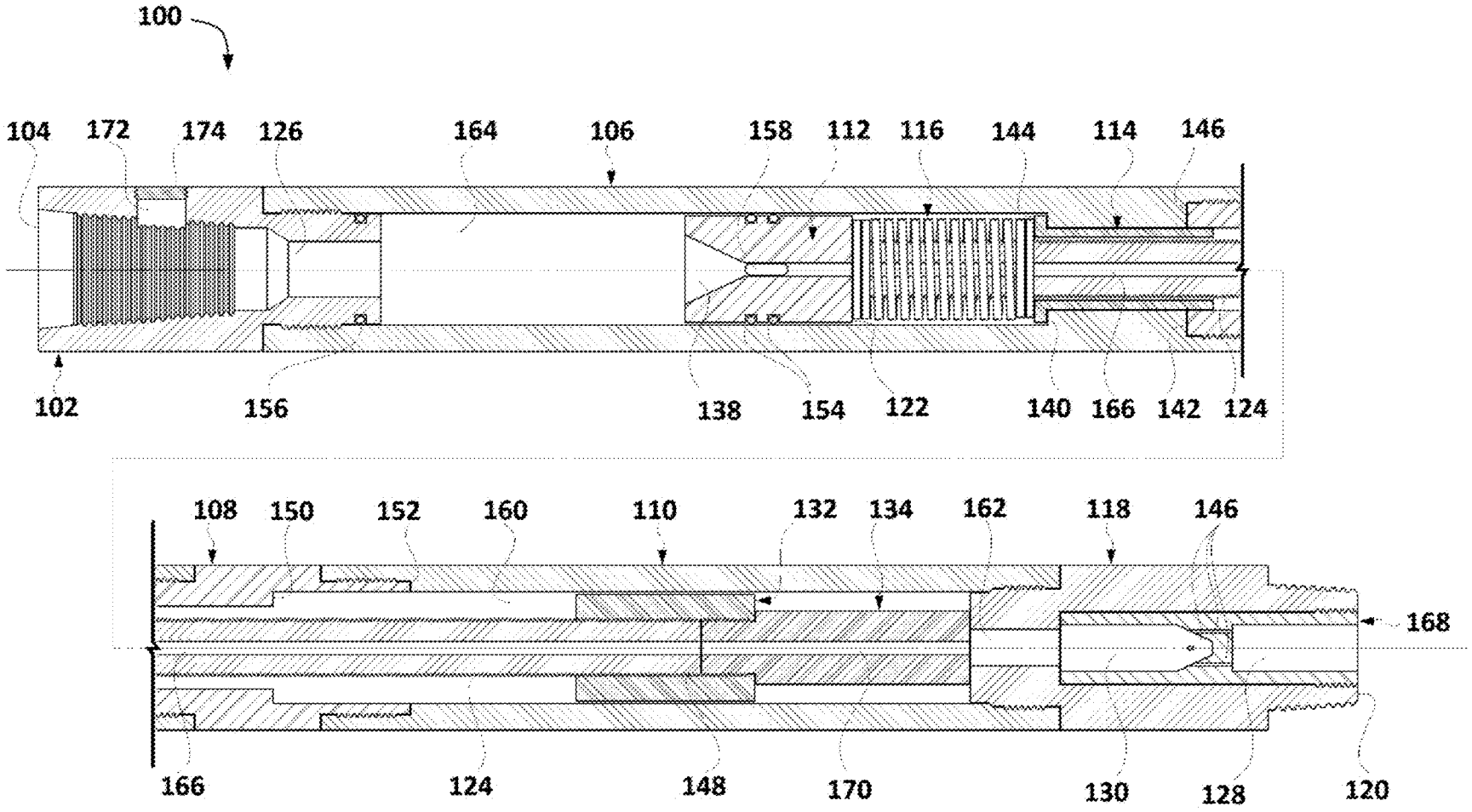
FIG. 3C shows the position of the device after that in FIG. 3B, wherein the deformable sphere 158 has been forced past the inlet 138 and into channel 166.
Figure 3D:
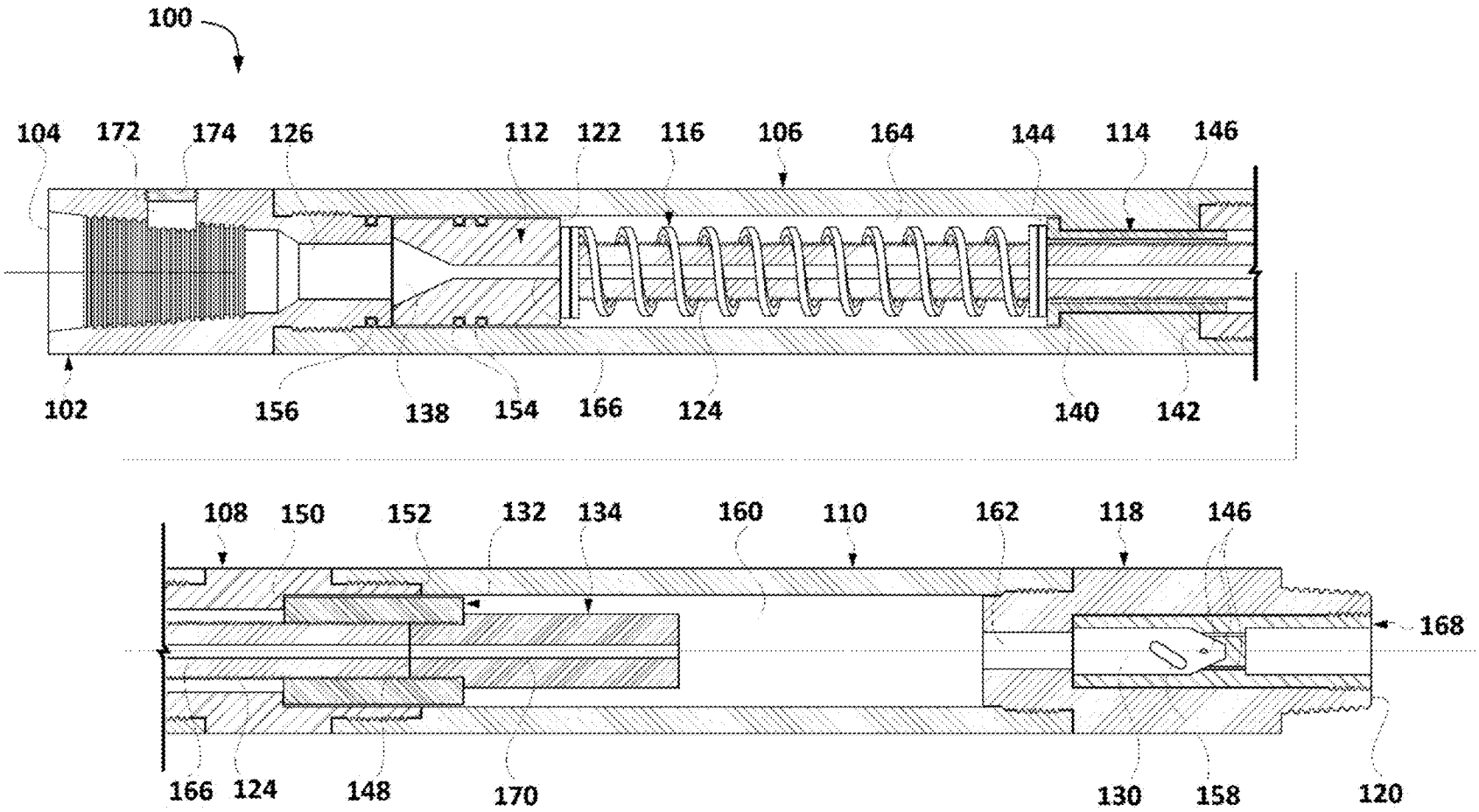
FIG. 3D shows the position of the device after that in FIG. 3C, wherein the deformed sphere 158 has been forced past channel 166 and into the filter 168.
Figure 4:
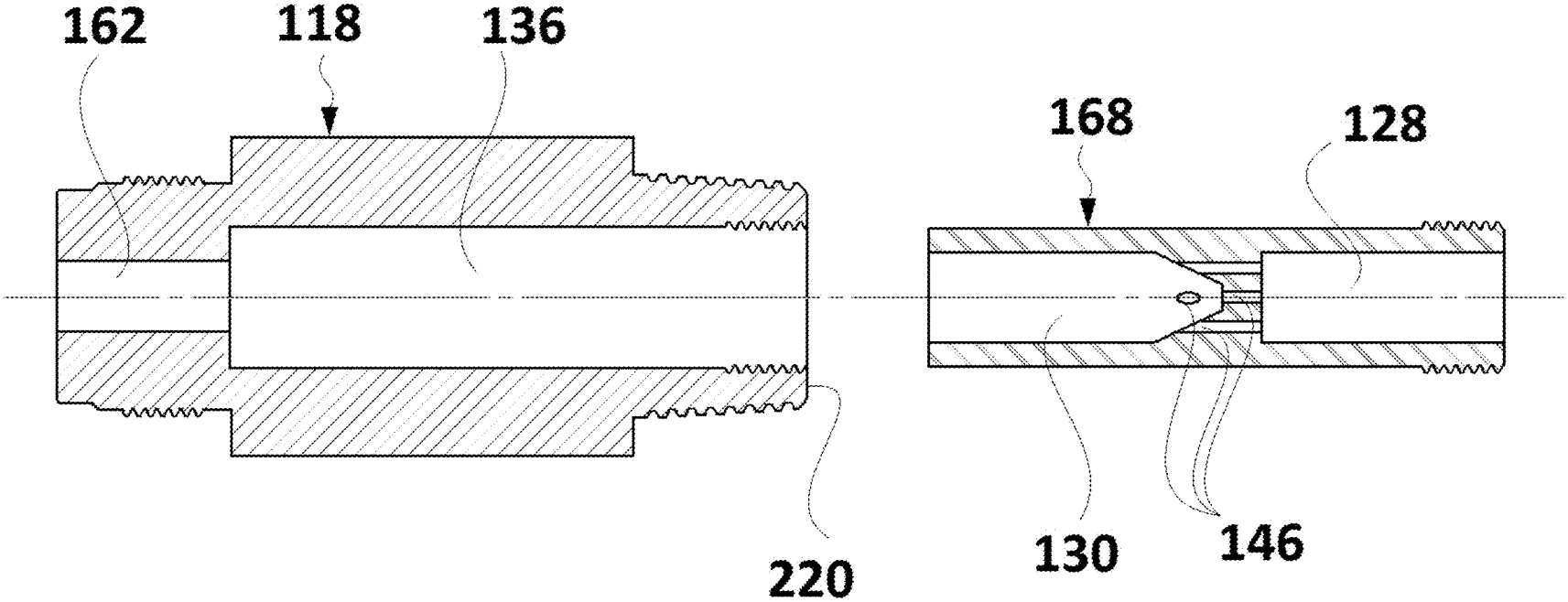
FIG. 4. illustrates a cross-sectional view of a lower sub 118 and an unscrewed filter 168 for use in the first embodiment of the invention.

A contiguous longitudinal bore in lower sub 118 is formed by two interconnected sub-bores 162 and 136 (illustrated in FIG. 4). The diameter and length of sub-bore 136 is greater than the diameter of sub-bore 162. A filter 168 is installed within the sub-bore 136 by screwing its externally threaded lower end with the internally threaded lower end of sub-bore 136 (as illustrated in FIGS. 2 and 3A to 3D). Filter 168 includes a capture cup 130, a drain bore 128, and flow channels 146 interconnecting the capture cup 130 and the drain bore 128.

The inner surface of the lower end of upper barrel 106 is threaded to a cylinder 114 having a flange 144 at its upper end. The lumen of upper barrel 106 includes a narrowed region (where the wall has greater thickness) bounded by an upper end 140 and a lower end 142. Cylinder 114 extends through the upper barrel 106 lumen within the narrowed region, while flange 144 of the cylinder 114 is above and positioned on upper end 140. Externally threaded shaft 124 extends through the bore of cylinder 114.

The lumen of center sub 108 also varies along its length. As illustrated, the portion of center sub 108 between the upstream end 146 and the strike receiving end 150 has a narrowed lumen (and the wall has greater thickness) than the portion between the strike receiving end 150 and the downstream end 152.

In an assembled jarring tool 100, spring 116 lies between seat 122 and flange 140. The upper sub 102, the upper barrel 106, the center sub 108, the lower barrel 110, the pressurizing insert 112, the upper hammer head 132, the lower hammer head 134 and the lower sub 118, all include longitudinal bores extending in axial alignment with channel 166. Lumens of the upper barrel 106, the lower barrel 110, and the lower hammer head 134 are illustrated as lumens 164, 160, and 170 respectively.

The internal/external diameter of mentioned threaded portions of each component match to mate with external/internal diameters of threaded portions of its corresponding adjacent component to form an assembled jarring device 100.

To assemble jarring device 100 (as shown in FIG. 2, 3A-3D), the spring 116 is slipped over the threaded shaft 124 and is placed adjacent to the seat 122. Thereafter, cylinder 114 is slipped over the threaded shaft 124 in a manner such that spring 116 rests on flange 144. The pressurizing insert 112 is then inserted into the upper barrel 106 from its upper e end such that the seat 122 lies within upper barrel 106, and threaded shaft 124 extends beyond the lower end of upper barrel 106. The uncovered length of threaded shaft 124 is passed through the lumen of center sub 108, and the upper end of center sub 108 is screwed with the lower end of upper barrel 106. Some length of threaded shaft 124 extends beyond the lower end 152 of center sub 108.

Thereafter, threaded extension 148 of lower hammer head 134 is screwed into the internally threaded bore of upper hammer head 132. The other end of upper hammer head 132 is screwed over threaded shaft 124 whereby the remaining length of the internally threaded bore of upper hammer head 132 resides over threaded shaft 124. As a result of this assembly, upper hammer head 132 is placed adjacent to, and is in contact with the strike receiving end 150 of center sub 108. Then, the externally threaded lower end of upper sub 102 is screwed into the internally threaded upper end of upper barrel 106, the upper end of lower barrel 110 is screwed over the lower end of center sub 108, and the lower end of lower barrel 110 is screwed over the upper end of lower sub 118. When upper barrel 106 is screwed to upper barrel 102, the lower end of upper barrel 102 is placed adjacent to seat 122. Finally, filter 168 is installed within the sub-bore 136 by screwing its externally threaded lower end into the internally threaded lower end of sub-bore 136 (as illustrated in FIGS. 2 and 3A to 3D).

Figure 2:
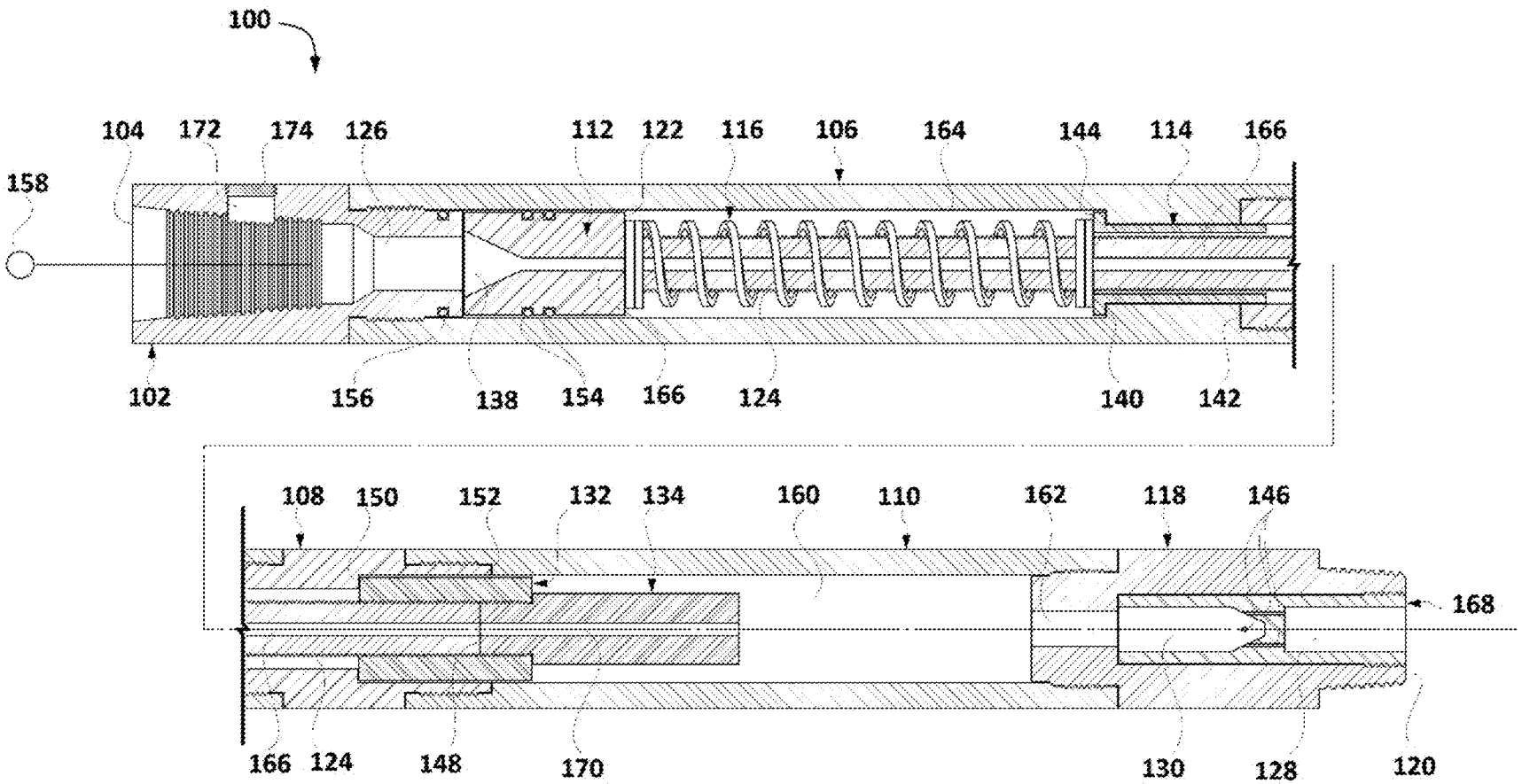
FIG. 2 is a cross-sectional view of the assembled said first embodiment of the jarring device, in position prior to inserting a sphere to block fluid flow.

In the assembled jarring device 100 (as shown in FIGS. 2 to 3D), upper barrel 106 connects upper sub 106 and center sub 108, and lower barrel 110 connects center sub 108 and lower sub 118. Further, on compression or de-compression of spring 116, the pressurizing insert 112 along with the upper hammer head 132 and the lower hammer head 134 slide within the lumens of upper barrel 106 and lower barrel 110. To provide a leakproof interface between the outer surface of seat 122 and the inner surface of upper sub 106, two O-rings 154 surround the outer surface of seat 122. Similarly, to avoid pressurized fluid leaks through interface between upper sub 102 and upper barrel 106, an O-ring 156 surrounds the lower end of upper sub 102.

A deformable sphere 158 (which in the current embodiment is spherical in shape) is essential for operating the jarring device 100. In the normal or undeformed state, the diameter of sphere 158 is small enough to allow it to pass through all longitudinal bores except bore 166, bore 170 and flow channels 146. In the current embodiment, channels 166 and 170 have equal diameter, and the diameter of flow channels 146 is significantly less than that of bores 166 and 170. In the present embodiment the deformable sphere 158 is preferably made of nylon. However, based on requirements of degree of deformability and suitability of the working environment, other materials may be used.

Operation of the jarring device 100, for producing jarring impacts will now be explained with help of accompanying FIGS. 2 to 3D. It is to be noted that in addition to the fluid flow described below for an operational jarring device 100, there may be minor flows (or leakage) of fluid, particularly through gaps between outer surface of slidable components and their surrounding surfaces. Any such flows which would not affect operation of device 100 are not addressed.

During operation of jarring device 100 (which can take place sub-surface and preferably in conjunction with coiled tubing drilling operations), pressurized fluid is pumped into upper sub 102. An initial positioning of the tool components is illustrated in FIG. 2. Pressurized fluid flows into the bore 126 of the upper sub 102, and gets delivered into the longitudinal fluid inlet 138 of the pressurizing insert 112. After traveling through fluid inlet 138, and after travelling through the bores in seat 122 and in externally threaded shaft 124, the pressurized fluid gets delivered into longitudinal bore 170 of lower hammer head 134. From longitudinal bore 170 the pressurized fluid gets delivered into sub-bore 162 of lower sub 118. After travelling through the filter 168 (i.e. through capture cup 130, flow channels 146 and drain bore 128) the pressurized fluid finally exits end 120.

For generating jarring/hammer impacts in an operational jarring device 100, deformable sphere 158 is pumped into the jarring device 100 through fluid inlet end 104. The deformable sphere 158 travels through central bore 126 of upper sub 102 (illustrated in FIG. 3A) and gets delivered into fluid inlet 138 of pressurizing insert 112. The deformable sphere 158 travels further through the upper part of the funnel shaped fluid inlet 138 and then jams at the inlet of channel 166 (note that the inner diameter of channel 166 is smaller than the outer diameter of deformable sphere 158, as illustrated in FIG. 3B). As deformable sphere 158 jams and sticks on the inlet of channel 166, it blocks the downstream flow of pressurized fluid further into jarring device 100, and thereby also blocks downstream flow of pressurized fluid in the drill string. Such blockage generates increased fluid pressure upstream of the blockage. Such increased pressure pushes pressurizing insert 112 and spring 116 downstream. Since downstream displacement of spring 116 is blocked by flange 144 (held against upper end 140), spring 116 gets compressed, and pressurizing insert 112 slides downstream causing lower hammer head 134 to strike the upper end of lower sub 118 (illustrated in FIG. 3B) to generate a first jarring impact. So, an obstruction in flow of pressurized fluid, caused by the deformable sphere 158, through channel 166 results in compression of string 116 and sliding of the hammer assembly in the downstream direction to generate a first jarring impact.

As the fluid pressure is increased by the pump operator, and once the fluid pressure passes a threshold, the sphere 158 gets deformed and is pushed into channel 166 (illustrated in FIG. 3C). Maintenance of the pressure causes the deformed sphere to travel through and eventually exit channel 166, and pass into sub-bore 162 of lower sub 118. As soon as deformed sphere 158 enters sub-bore 162 (which has a significantly greater inner diameter than the outer diameter of deformed sphere 158), the blockage in the flow path is cleared, and fluid gushes out of the end 120 (after travelling through filter 168). Since the diameter of flow channels 146 is significantly less than that of channels 166 and 170, the ejected deformed sphere 158 (which after deformation likely resembles an elongated cylinder with an outer diameter substantially the same as the inner diameter of channels 166 and 170) becomes trapped in the capture cup 130 (to be removed later).

Ejection of deformed sphere 158 from bore 170 results a sudden drop of fluid pressure and concomitant decompression of spring 116. As spring 116 decompresses, it forces pressurizing insert 112 to rapidly slide upstream and carries upper hammer head 132 to forcefully strike the strike receiving end 150 of center sub 108 (illustrated in FIG. 3D) generating a second jarring impact. So, a release of obstruction in flow of pressurized fluid through channel 166, caused by deformation of the deformable sphere 158, results in decompression of string 116 and sliding of the hammer assembly in upstream direction to generate a second jarring impact. Thereafter, jarring device 100 is at its initial position (as illustrated in FIG. 2) and is ready to receive another fresh deformable sphere for generating the next set of jarring impacts.

Over the time, multiple deformed spheres (after use for generation of jarring impacts) get captured in capture cup 130. These captured deformed spheres can then be retrieved by separating filter 168 from lower sub 118 (by simply unscrewing it), and then be discarded as waste. It is to be noted that jarring device 100 can be used with equal efficiency and performance without filter 168 being installed in lower sub 118. However, operating jarring device 100 without filter 168 in place would lead to deformed spheres delivered into the coiled tubing, and may result in blocking of the coiled tubing, the BHA or other equipment installed downstream.

During operation, use of a sphere which fails to sufficiently deform and pass through channel 166, or any other defects in construction of bores or channels may result in a dangerous rise in fluid pressure to the point where it threatens the integrity of jarring device 100. To provide protection against such over-pressure, a pressure release vent 172 is provided. During normal pressure and operation of jarring device 100, pressure release vent 172 remains plugged by rupture disc 174 (as described above). However, once the pressure level within jarring device 100 exceeds a threshold, it causes rupturing of rupture disc 174, and allows fluid to be released through pressure release vent 172. A malfunctioning deformable sphere (which is unable to enter and traverse through channel 166) may be retrieved through an open pressure release vent 172.

A second embodiment of the present invention, jarring device 200, will now be described in conjunction with FIGS. 5 and 6A to 6D. Unless mentioned otherwise, all components of the jarring device 200 are similar in structure and function to corresponding components of the first embodiment.

Structurally the second embodiment is the same as the first embodiment described above, except that the second embodiment employs a slicer 276 (which employs only a single blade but can be an assembly of two or more blades) to slice a deformable sphere and initiate pressure release, which is placed at the inlet of bore 266.

Similar to the first embodiment, the jarring device 200 includes an upper sub 202, an upper barrel 206, a center sub 208, a lower barrel 210, a pressurizing insert 212, spring 216, an externally threaded shaft 224, a cylinder 214 having a flange 244, a pressure release vent 272, a rupture disc 274, a filter 268, an upper hammer head 232, a lower hammer head 234, and a lower sub 218. The assembly of upper hammer head 232, lower hammer head 234 and pressurizing insert 212 along with spring 216, is herein referred to as the hammer assembly of the jarring device 200.

Figure 5:
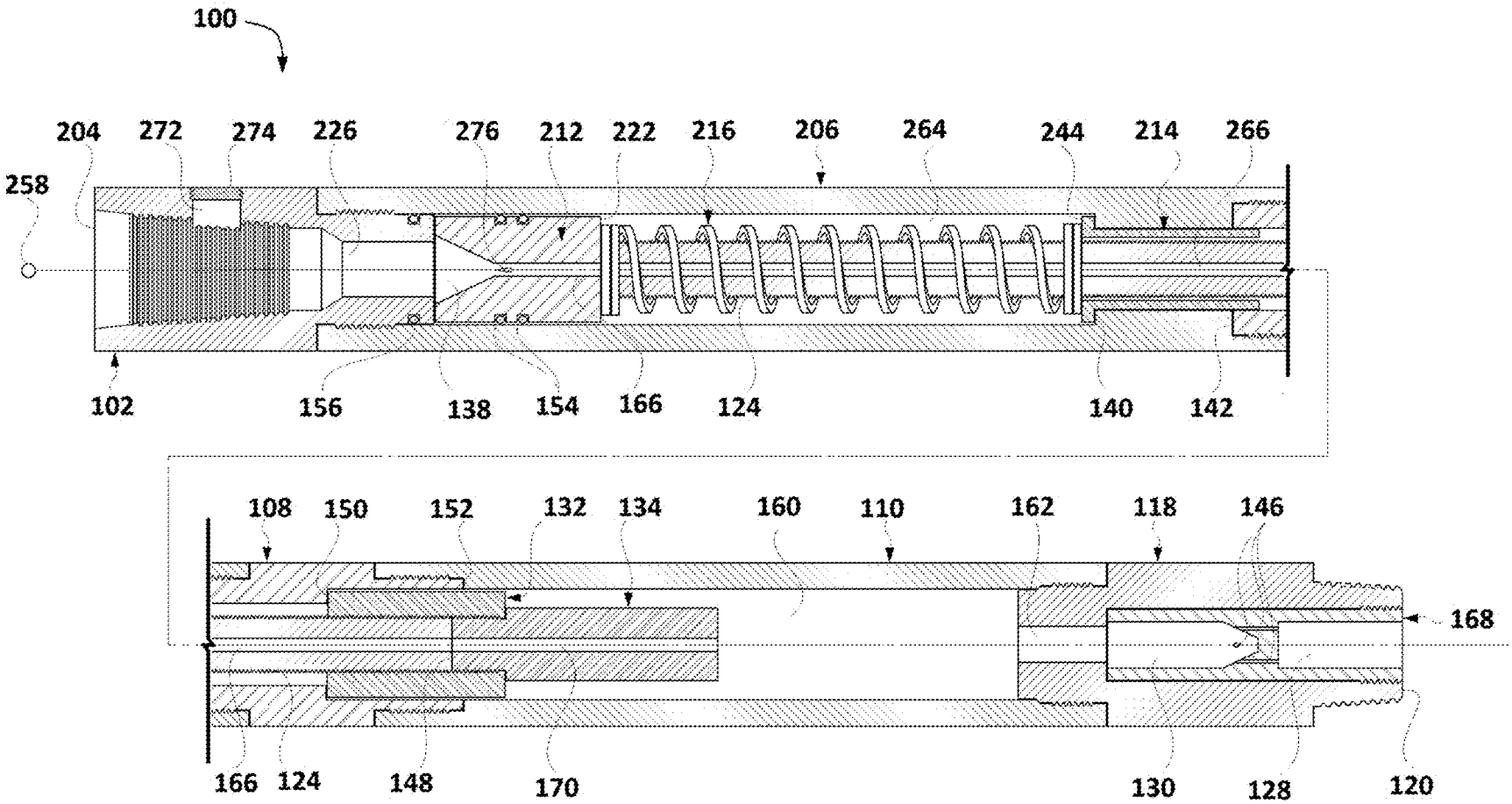
FIG. 5 is a cross-sectional view of an assembled second embodiment of the jarring device, in position prior to inserting a deformable sphere to obstruct fluid flow.
Figure 6A:
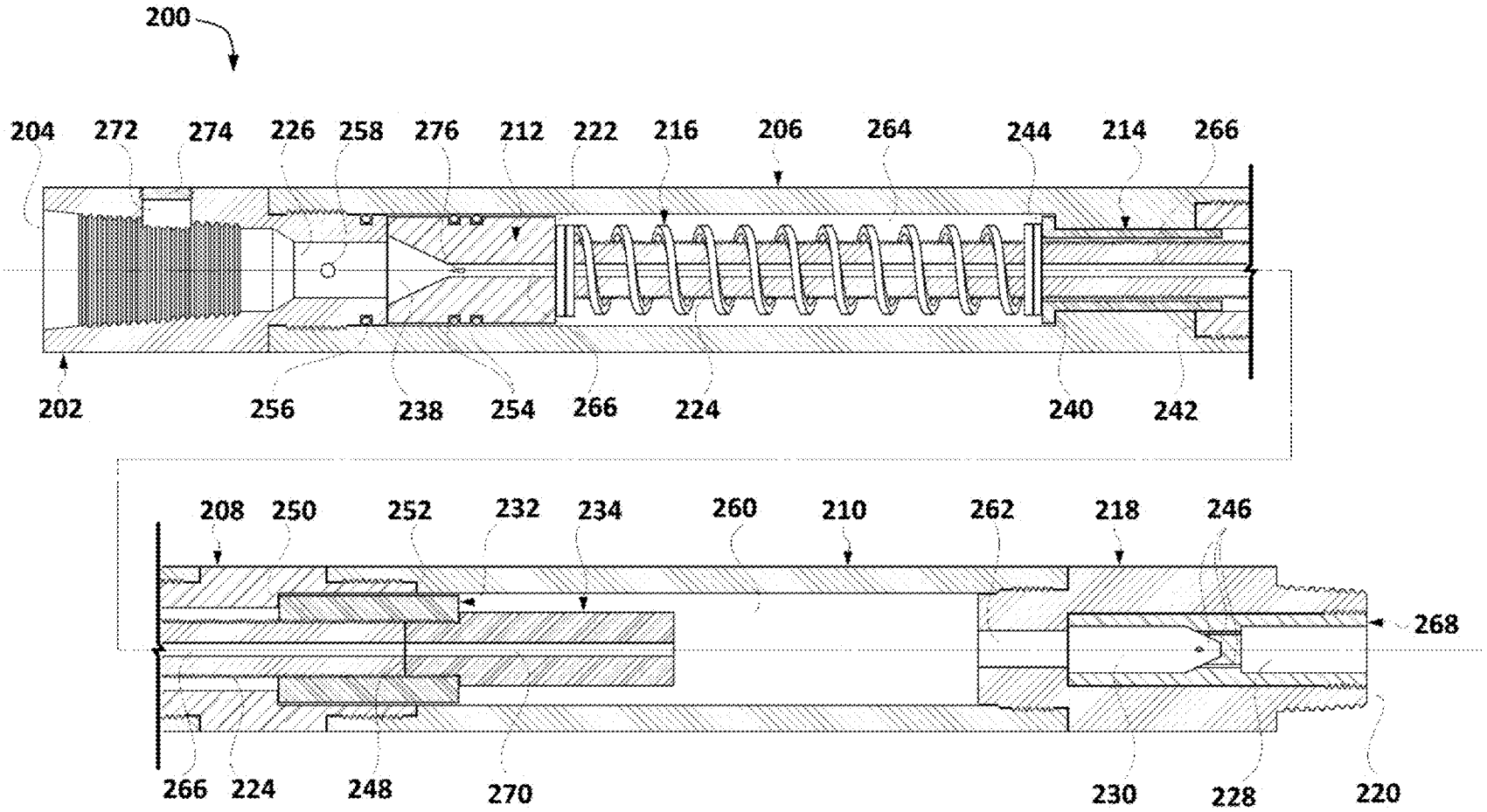
FIG. 6A shows the same view as FIG. 5, but with deformable sphere 258 traveling further downstream and towards the inlet 238 to obstruct the fluid flow.
Figure 6B:
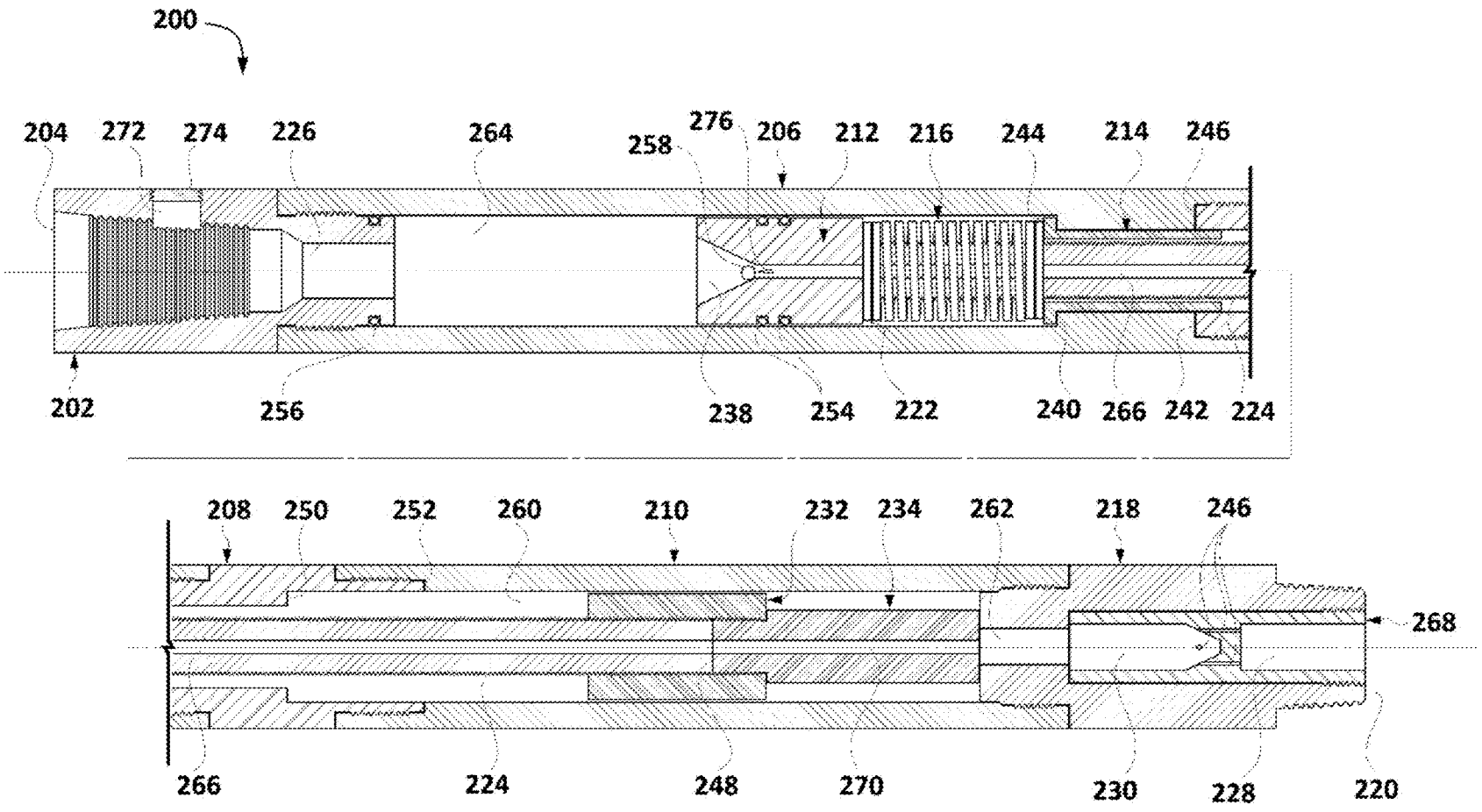
FIG. 6B shows the position of the device shown in FIGS. 5 & 6A, following obstructing of the inlet 238 by deformable sphere 258 thereby initiating partial compression of spring 216.
Figure 6C:
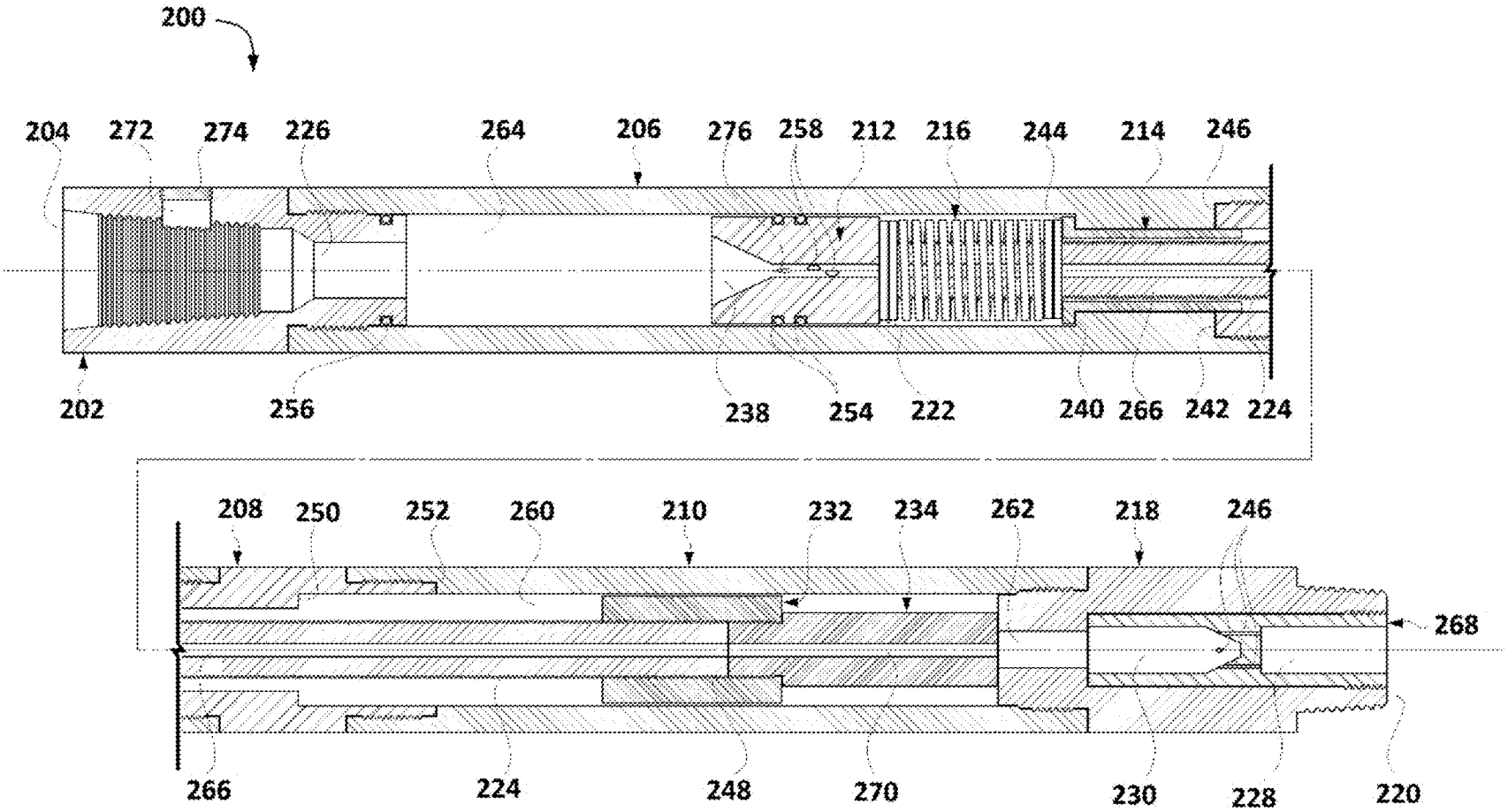
FIG. 6C shows the position of the device after that in FIG. 6B, wherein the deformable sphere 258 has been sliced and flushed into channel 266.
Figure 6D:
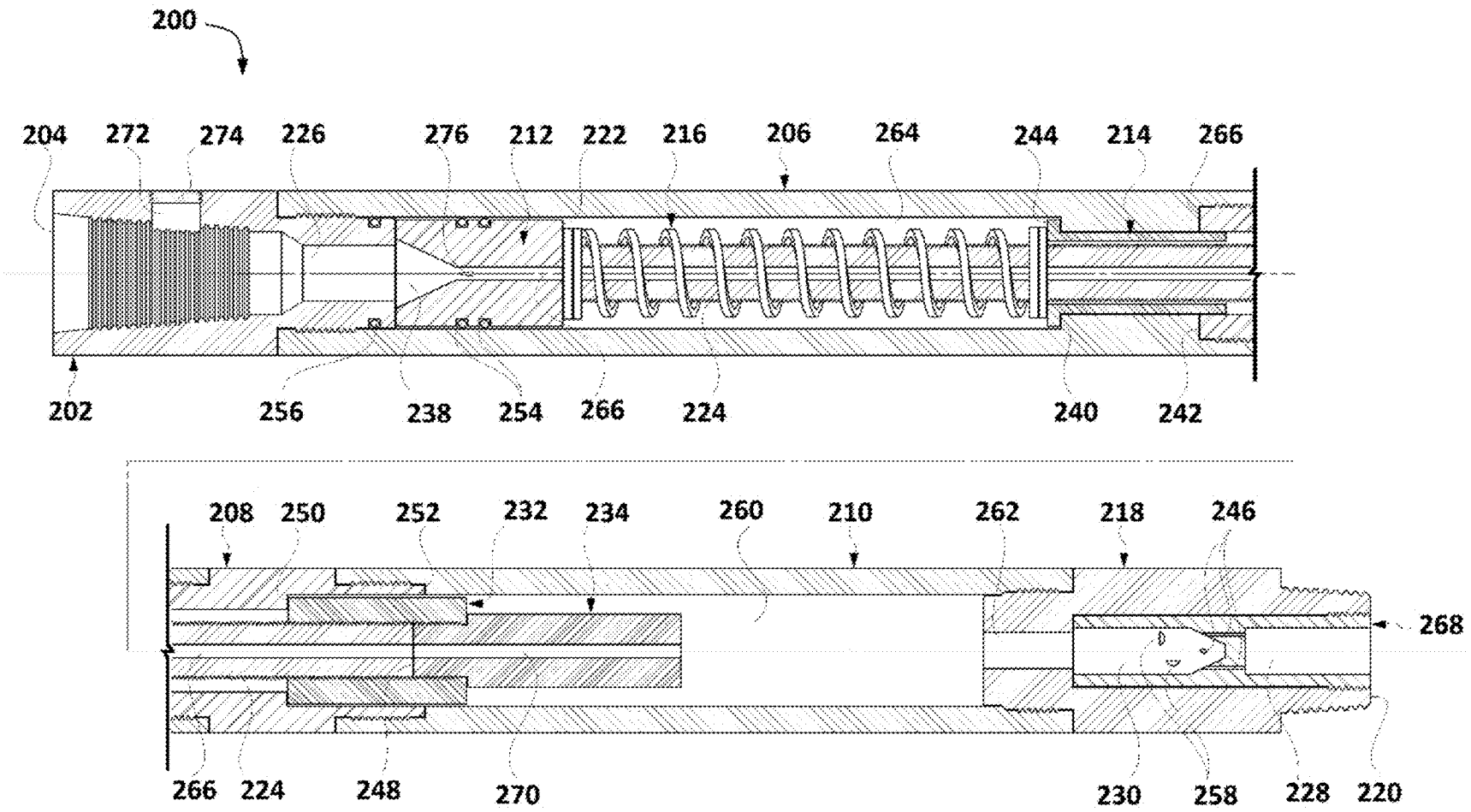
FIG. 6D shows the position of the device after that in FIG. 6C, wherein the slices of deformed sphere 258 have been forced past channel 266 and into the filter 268.

Initial positioning of the components of jarring device 200 is illustrated in FIG. 5. For generating jarring/hammer impacts in an operational jarring device 200, a sphere 258 (which in the current embodiment is spherical in shape, and preferably, has a smaller diameter than the deformable sphere used in the first embodiment) is pumped down into jarring device 200 through upper sub 202 (illustrated in FIG. 6A). Sphere 258 travels into the funnel shaped fluid inlet 238 and then gets stuck onto the slicer 276. Once stuck, it obstructs free flow of pressurized fluid through channel 266, and causes a sharp reduction in the downstream flow of pressurized fluid, thus generating increased fluid pressure in the flow path upstream of sphere 258. The pressure pushes the pressurizing insert 212 and the spring 216 downstream. Since downstream displacement of the spring 216 is blocked by flange 244 (held against upper end 240), the spring 216 gets compressed and the pressurizing insert 212 slides downstream causing the lower hammer head 234 to strike the upper end of the lower sub 218 (illustrated in FIG. 6B) to generate a first jarring impact. So, an obstruction in flow of pressurized fluid, caused by the deformable sphere 258, through channel 266 results in compression of string 216 and sliding of the hammer assembly in the downstream direction to generate a first jarring impact.

The operator increases the fluid pressure, and once pressure surpasses a threshold, the deformable sphere 258 gets pushed further into slicer 276, which then slices sphere 258 into smaller parts, such that these parts can pass (or be flushed) through channel 266 (illustrated in FIG. 6C) and later be captured at capture cup 230 (note that the diameter of flow channels 246 should be less than the outer diameter of the smallest slices).

Slicing of sphere 258 opens up the flow path of the pressurized fluid within jarring device 200, and pressurized fluid exits end 220 (after travelling through filter 268). This results in a drop of fluid pressure and decompression of spring 216. As spring 216 decompresses, it forces pressurizing insert 212 to slide rapidly upstream and it carries upper hammer head 232, which forcefully strikes the strike receiving end 250 of center sub 208 (illustrated in FIG. 6D) generating a second jarring impact. So, a release of obstruction in flow of pressurized fluid through channel 266, caused by slicing of the deformable sphere 258, results in decompression of string 216 and sliding of the hammer assembly in upstream direction to generate a second jarring impact. Thereafter, jarring device 200 ends up at its initial position, as illustrated in FIG. 5, ready to receive another sphere for generating the next set of jarring impacts.

Over the time, slices of multiple spheres (which have been used for generation of jarring impacts) get captured in the capture cup 230. These captured spheres can then be retrieved and the filter can be cleaned, as explained above for the first embodiment. Similar to the first embodiment, pressure vent 272 and rupture disc 274 provide protection against over-pressure. Jarring device 200 can be also used without filter 268, but with the same potential complications noted as if filter 168 is eliminated in the first embodiment.

Though in slicer 276 of the current embodiment, only one blade is used, it is to be understood that in other embodiments of the invention, if an assembly of two or more blades is used, then the separation between blades should be small enough such that the generated slices of spheres are small enough to pass through channels 266 and 270, but are large enough to not pass through flow channels 246. Still further, in the current embodiment, though slicer 276 is placed at the inlet of channel 266, in the other embodiments of the invention slicer 276 may well be placed anywhere within channel 266.

In embodiments of the invention in which slicer 276 is installed within a channel but not at its inlet, the compression of the spring would be generated by obstructing the channel using a deformable sphere. However, the decompression of the spring would be generated on releasing the obstruction on flow path by first deforming the sphere to allow it to be pushed into the slicer, and then pressure is released through the sphere while it's being sliced; and after it's dissected and flushed through channels 266 and 270.

Figure 7:
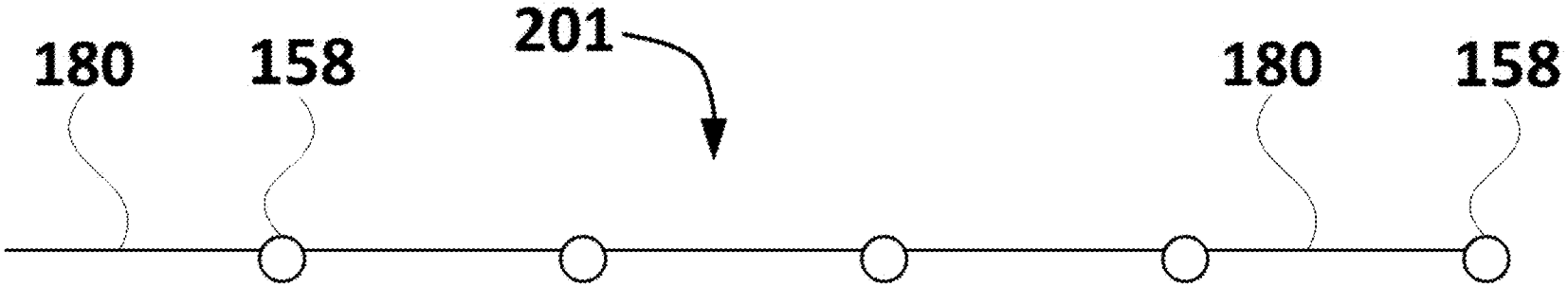
FIG. 7 shows a series of deformable or sliceable spheres held together by a stem running through the series of spheres.
Figure 8:
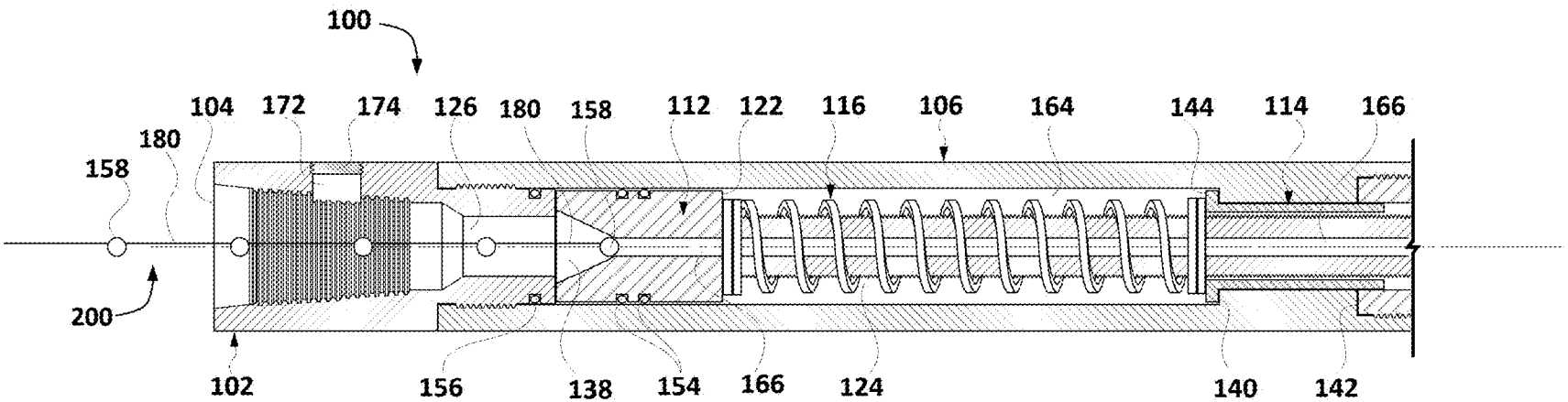
FIG. 8 shows a series of deformable or sliceable spheres held together by a stem with the leading sphere positioned in the inlet 138 to block the fluid flow.
Figure 9:
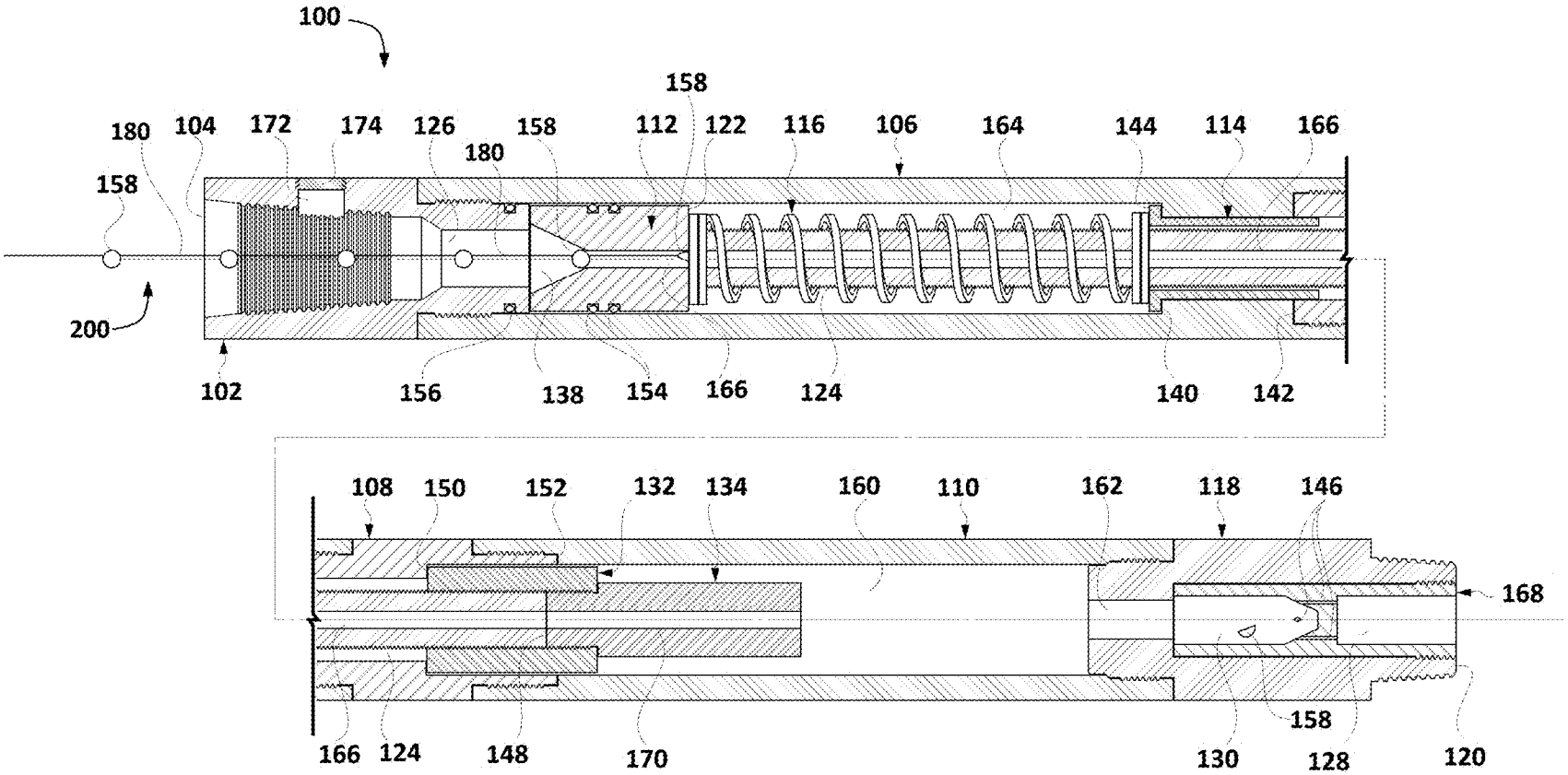
FIG. 9 shows a series of deformable or sliceable spheres held together by a stem, where the leading sphere has passed through the upper portion of the device, and the next sphere on the stem is positioned in the inlet 138 to block the fluid flow.

In another embodiment, illustrated in FIGS. 7-9, a series 201 of deformable or sliceable spheres 158 are held together by a stem 180 running through the series of spheres 158. Using series 201 reduces the time required for sequentially feeding in individual spheres 158, as described below.

For generating jarring/hammer impacts, series 201 is pumped into the jarring device 100 (shown) or 200 (not shown) through fluid inlet end 104 or 204, respectively. In FIG. 8, the leading sphere 158 of series 201 is positioned to block flow into channel 166. As the fluid pressure is increased (by pump control) and once the fluid pressure passes a threshold, the leading sphere 158 gets deformed and is pushed into channel 166, then through it, as described above. The next sphere 158 of series 201 is then positioned to block flow into channel 166, and the cycle repeats until all spheres 158 of series 201 have passed through and generated jarring impacts. The same steps are used where device 200 is used, the difference being that each sphere 158 of series 201 is sliced by slicer 276, rather than deformed.

The number of spheres 158 in series 201 and their spacing can be varied, to control the number of jarring actions and their frequency, respectively. The spheres 158 in series 201 can also be set to deform or shear at different pressures (e.g., from 3,0000 to 8,000 psi, or as low as 800 and up to 12,000 psi) by adjusting their size, composition or leaving varying proportions of their cores hollow. The ability to adjust the deformation/shearing pressure of spheres 158 allows setting of jarring forces; where increased deformation/shearing pressure required for spheres 158 generates increased jarring force. Stem 180 should be longitudinally flexible enough and/or brittle enough when forces are applied to its cross-section such that the operating fluid pressures can bend it or break it if it's immobilized within the devices 100, 200, respectively, and then pass the deformed or broken stem 180 through the channels 266 and 270, and downstream through the devices 100, 200.

In the above described embodiments, though the spheres 158 are described as spherical in shape, other embodiments of the inventions, based on their requirements, may use deformable spheres having non-spherical shapes. For example: some embodiments of the invention may use deformable spheres which are shaped as a cone or a frustum or an ellipsoid or a cylinder or a cuboid. It is also to be understood that in embodiments of the present invention, the shape (including other than spherical) dimensions and materials of deformable spheres may be selected based on anticipated fluid pressure, usage environment, and overall dimensions of relevant components within the tool. As an example, various sizes of deformable spheres may be used to operate a given embodiment of jarring device which employs particular levels of operating pressure. Diameters of deformable spheres may be increased (i.e., made increasingly larger than the inner diameter of the channel 166) to operate at greater operating pressures, which can range, for example, from 800, to 6000, to 9000 or to 12,000 psi.

Similarly, the design of the type of slicer 276 (including the number of blades used in it) may also be varied based on the dimensions of slices required and desired ease of slicing. All such embodiments are within the scope of the invention.

Still further, it should be understood that in embodiments of the present invention, apart from the pressure release mechanisms (i.e. arrangements of the pressure release vents and corresponding rupture discs used in the embodiments above), and the filter types described above, various other types of pressure release mechanisms and filter types may be used. All such embodiments are within the scope of the invention. Further, it is to be understood that for a given fluid pressure the material of each component, its dimensions (such as diameters, lengths, thickness) and, orientation and dimensions of fluid flow passages of the embodiment of jarring device described above may be selectively chosen so as to vary timing and magnitude of jarring/hammering impacts. All such variations in embodiments of the present invention as well as all equivalents of the device and its variations, are within the scope of invention.

What is claimed is:

1. A jarring device controlled by pressurized fluid flow through it, comprising:

a hammer assembly which reciprocates within the device, moving: (i) in a downstream direction when fluid flow through the device is blocked by a deformable member which obstructs fluid flow through a channel in the device thereby causing increased pressure upstream of the hammer assembly (ii) in an upstream direction when the deformable member is forced to deform, using fluid pressure, and pass through the channel, whereby the increased pressure upstream is released and a spring, compressed with downstream movement of the hammer assembly, decompresses; and whereby the hammer assembly's downstream movement is arrested on impact of a portion of the hammer assembly with a first portion of the device, thereby generating a first impact, and whereby a second impact is generated upon arresting decompression of the spring when an upper surface of the hammer assembly hits a second portion of the device.

2. The jarring device of claim 1, wherein said jarring device is installed in coiled tubing and positioned in a wellbore.

3. The jarring device of claim 1, wherein said deformable member is a substantially spherical.

4. The jarring device of claim 1, wherein said deformable member is non-spherical in shape.

5. The jarring device of claim 4, wherein said deformable member is: a cone, a frustum, an ellipsoid, a cylinder or a cuboid.

6. The jarring device of claim 1, wherein said jarring device further includes a pressure release vent for protection against over-pressure from the increased upstream pressure.

7. The jarring device of claim 1, wherein said jarring device further includes a filter for capturing the deformable member.

8. The jarring device of claim 1, wherein the hammer assembly includes a lower hammer head attached to and downstream from a hammer, and the lower surface of the lower hammer head impacts an internal portion of a lower sub of the device, at the first impact.

9. The jarring device of claim 8, wherein the second portion of the device is an internal portion of a center sub.

10. The jarring device of claim 1, wherein said jarring device further includes a filter for capturing the member after it passes through the channel.

11. A jarring device controlled by pressurized fluid flow through it, comprising:

a hammer assembly which reciprocates within the device, moving: (i) in a downstream direction when fluid flow through the device is blocked by one of a series of members wherein each said member in the series initially obstructs fluid flow through a channel in the device thereby causing increased pressure upstream of the hammer assembly (ii) in an upstream direction when under fluid pressure, one of the members is deformed or cut, and passes through the channel, whereby the increased pressure upstream is released and a spring, compressed with downstream movement of the hammer assembly, decompresses; and whereby the hammer assembly's downstream movement is arrested on impact of a portion of the hammer assembly with a first portion of the device, thereby generating a first impact, and whereby a second impact is generated upon arresting decompression of the spring when an upper surface of the hammer assembly hits a second portion of the device.

12. The jarring device of claim 11, wherein the series is connected by a stem.

13. The jarring device of claim 12, wherein the stem is longitudinally flexible.

14. The jarring device of claim 12, wherein the stem breaks or bends if held immobile and subject to fluid pressures above 800 psi.

15. The jarring device of claim 11, wherein the spacing between the members in the series varies.

16. The jarring device of claim 11, wherein the size, composition or cores of the members in the series vary.

17. The jarring device of claim 11, further including a slicer to cut the members.

18. The jarring device of claim 11, wherein the members are spherical.

19. The jarring device of claim 11, wherein said jarring device further includes a pressure release vent for protection against over-pressure from the increased upstream pressure.

20. The jarring device of claim 11, wherein the hammer assembly includes a lower hammer head attached to and downstream from a hammer, and the lower surface of the lower hammer head impacts an internal portion of a lower sub of the device, at the first impact.

21. The jarring device of claim 20, wherein the second portion of the device is an internal portion of a center sub.

* * * * *